US010465931B2

(12) United States Patent
Barrett

(10) Patent No.: US 10,465,931 B2
(45) Date of Patent: Nov. 5, 2019

(54) AUTOMATED CONTROL AND PARALLEL LEARNING HVAC APPARATUSES, METHODS AND SYSTEMS

(71) Applicant: Schneider Electric IT Corporation, West Kingston, RI (US)

(72) Inventor: Enda Barrett, Salthill (IE)

(73) Assignee: Schneider Electric IT Corporation, West Kingston, RI (US)

( * ) Notice: Subject to any disclaimer, the term of this patent is extended or adjusted under 35 U.S.C. 154(b) by 346 days.

(21) Appl. No.: 15/011,170

(22) Filed: Jan. 29, 2016

(65) Prior Publication Data

US 2016/0223218 A1 Aug. 4, 2016

Related U.S. Application Data

(60) Provisional application No. 62/110,419, filed on Jan. 30, 2015, provisional application No. 62/141,680, filed on Apr. 1, 2015.

(51) Int. Cl.

| | |
|---|---|
| ***F24F 11/30*** | (2018.01) |
| ***F24F 11/62*** | (2018.01) |
| *F24F 140/60* | (2018.01) |
| *F24F 120/20* | (2018.01) |
| *F24F 11/65* | (2018.01) |
| *F24F 11/54* | (2018.01) |
| *F24F 11/58* | (2018.01) |
| *F24F 11/46* | (2018.01) |

(52) U.S. Cl.

CPC ..... *F24F 11/30* (2018.01); *F24F 11/62* (2018.01); *F24F 11/46* (2018.01); *F24F 11/54* (2018.01); *F24F 11/58* (2018.01); *F24F 11/65* (2018.01); *F24F 2120/20* (2018.01); *F24F 2140/60* (2018.01)

(58) Field of Classification Search

CPC ..... F24F 11/006; F24F 2011/0047; F24F 2011/0057; F24F 2011/0064; F24F 2011/0071; F24F 2011/0075

USPC ..... 700/278

See application file for complete search history.

(56) References Cited

U.S. PATENT DOCUMENTS

| | | | | |
|---|---|---|---|---|
| 8,090,477 | B1 * | 1/2012 | Steinberg | G05D 23/1923 700/278 |
| 2005/0275547 | A1 * | 12/2005 | Kates | G08B 19/00 340/605 |
| 2006/0196953 | A1 * | 9/2006 | Simon | G05D 23/1934 236/46 R |
| 2006/0267756 | A1 * | 11/2006 | Kates | G01N 33/0065 340/521 |
| 2007/0044539 | A1 * | 3/2007 | Sabol | G06Q 10/06 73/19.01 |
| 2010/0084482 | A1 * | 4/2010 | Kennedy | F24F 11/0012 236/51 |
| 2012/0130547 | A1 * | 5/2012 | Fadell | F24F 11/0009 700/276 |

* cited by examiner

*Primary Examiner* — Dzung Tran
(74) *Attorney, Agent, or Firm* — Locke Lord LLP

(57) ABSTRACT

The AUTOMATED CONTROL AND PARALLEL LEARNING HVAC APPARATUSES, METHODS AND SYSTEMS ("ACPLHVAC") updates real time value function estimates through parallel and reinforcement learning, via ACPLHVAC components, by observing a defined state action space to maximize user Quality of Experience (QoE) and minimize associated energy required with regulating environmental spaces.

19 Claims, 11 Drawing Sheets

Example: Divergence Component, illustrating non-symmetric divergence between probability distributions P & Q Example: Quality of Experience (QoE) Interaction Embodiments

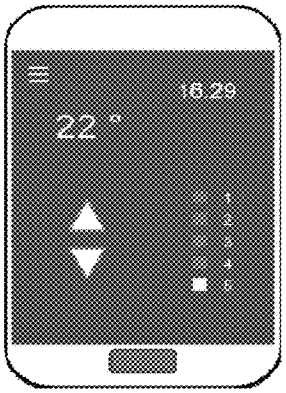

Possible Smartphone Embodiment of a HVAC QoE assessment interface 2 10

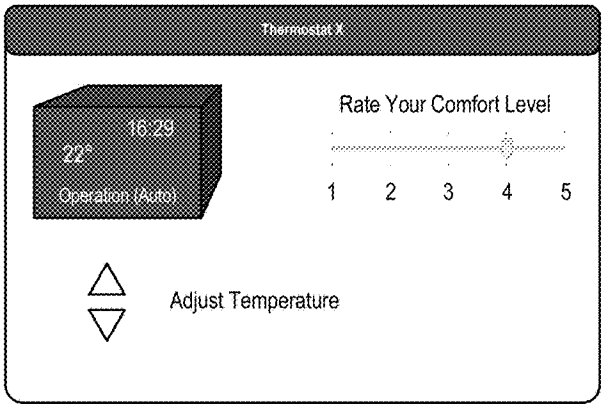

Possible Website or Computer Application Embodiment of a HVAC QoE assessment interface 2 12

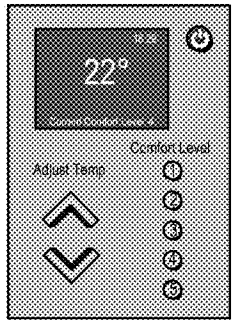

Possible Remote Control Embodiment of a HVAC QoE assessment interface 2 14

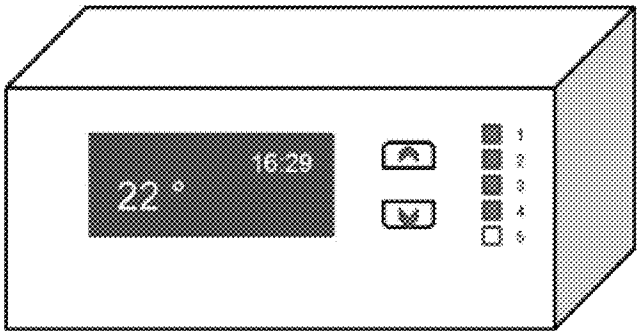

Possible Thermostat Embodiment of a HVAC QoE assessment interface 2 16

Example: Quality of Experience Interface Component Embodiments

Figure 2B

MOS between Setpoints 23° and 22° is not significant. However cost is. System automatically balances cost and comfort level. 2 20

| Room Temp (potential Setpoint) | Cost | MOS |
|---|---|---|
| 24°C | $40 | 3.7 |
| 23°C | $60 | 4.1 |
| 22°C | $80 | 4.14 |
| 21°C | $100 | 4.0 |
| 20°C | $120 | 3.95 |
| 19°C | $140 | 3.61 |
| 18°C | $160 | 3.01 |
| 17°C | $180 | 2.84 |

Mean Opinion Score (MOS) may reflect a different consensus than setpoint values and can be offset by cost calculations where MOS is not significantly differentiated. 2 18

Example: Mean Opinion Score and Associated Costs

Figure 2C

Example: Efficiency Metric over Area Sharing Information in Parallel

Example: Decision Component (Finite Markov Decision Process with no external influence)

Example: Reinforcement Learning Embodiment for an Isolated Unit

Example: Reinforcement Learning Embodiment for a Connected Unit

AUTOMATED CONTROL AND PARALLEL LEARNING HVAC APPARATUSES, METHODS AND SYSTEMS

This application claims the benefit of each of the following applications: (a) U.S. Provisional Patent Application No. 62/141,680, filed Apr. 1, 2015 and titled "AUTOMATED CONTROL AND PARALLEL LEARNING HVAC APPARATUSES, METHODS AND SYSTEMS"; and (b) U.S. Provisional Patent Application No. 62/110,419, filed Jan. 30, 2015 and titled "AUTOMATED CONTROL AND PARALLEL LEARNING HVAC APPARATUSES, METHODS AND SYSTEMS"; the entire contents of each of the aforementioned applications are herein expressly incorporated by reference.

This application for letters patent disclosure document describes inventive aspects that include various novel innovations (hereinafter "disclosure") and contains material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

FIELD

The present innovations generally address user environmental comfort management, and more particularly, include apparatuses, methods and systems for automated control and parallel learning heating, ventilation and air conditioning (HVAC).

BACKGROUND

Manual and programmable thermostats are standard in most buildings. A user can utilize such devices to control or modify the temperature in their homes or offices.

BRIEF DESCRIPTION OF THE DRAWINGS

The accompanying appendices and/or drawings illustrate various non-limiting, example, inventive aspects of AUTOMATED CONTROL AND PARALLEL LEARNING HVAC APPARATUSES, METHODS AND SYSTEMS (hereinafter "ACPLHVAC") in accordance with the present disclosure:

FIG. 2B shows some examples of QoE interface components in some embodiments and implementations of the ACPLHVAC.

FIG. 2C shows an exemplary chart of possible Mean Opinion Score (MOS) derivations combined with energy costs to avoid setpoint zealotry according to some embodiments of the ACPLHVAC.

Figure 1A:
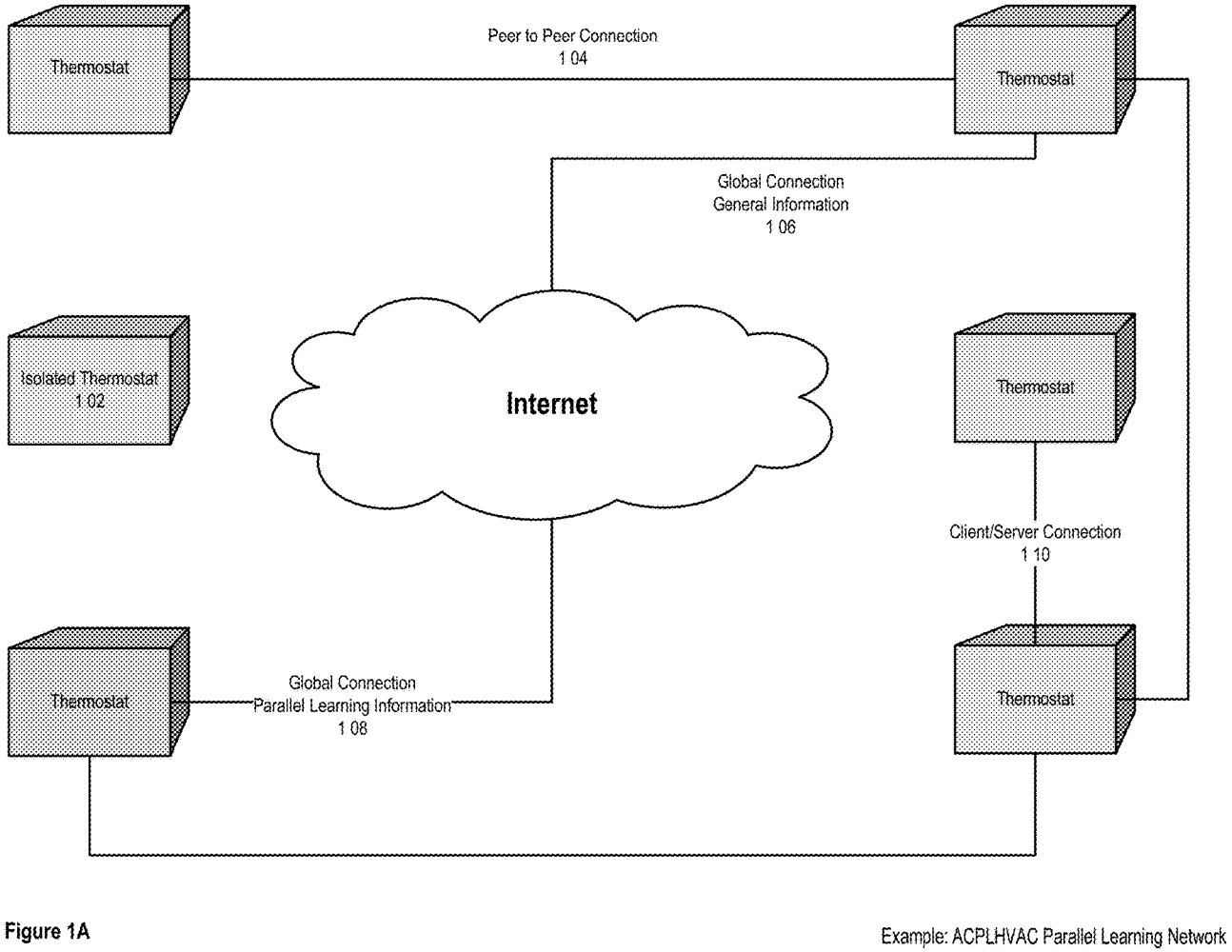
FIG. 1A shows a diagram illustrating example aspects of possible non-exclusive connection types for some embodiments of the ACPLHVAC.

The leading number of each reference number within the drawings indicates the figure in which that reference number is introduced and/or detailed. As such, a detailed discussion of reference number 101 would be found and/or introduced in FIG. 1. Reference number 201 is introduced in FIG. 2, etc.

DETAILED DESCRIPTION

The AUTOMATED CONTROL AND PARALLEL LEARNING HVAC APPARATUSES, METHODS AND SYSTEMS ("ACPLHVAC") update real time value function estimates through a reinforcement learning procedure, via ACPLHVAC components, by observing a defined state action space to maximize user Quality of Experience (QoE) and minimize associated energy requirements and costs with regulating environmental spaces.

Known thermostats are generally inefficient in achieving both minimal energy costs and maximal human comfort levels. Automated thermostats seek to eliminate the need for human interaction to reach and maintain setpoints. The disclosure improves on these automated designs by utilizing parallel learning a communications network to take advantage of environmental and situational similarities, as well as locally derived reasoning without extreme setpoint adherence to improve both comfort and cost efficiency of HVAC systems. In some embodiments, information determined or learned by one environment control device or thermostat/HVAC system (hereinafter "thermostat") or a series of thermostats is used to inform or set an initial or base policy or paradigm for a newly installed thermostat to aid learning and adaption for the new thermostat. Such thermostats are to be understood to be configured to connect with and/or control one or more sensors (including but not limited to temperature sensors, humidity sensors, light sensors, pressure sensors), one or more change devices (including but not limited to fans, air conditioners, heaters, radiators, humidifiers, vents, windows, shades, etc.), communication devices and/or interface devices. As an example of features for an ACPLHVAC embodiment, if a new thermostat is installed in a particular building or development, information from other similarly situated thermostats can be used to set a base policy for learning. Depending on the implementation, the selection of data used to set a base policy can be generalized or it can be specific to one or more details of the thermostat, such as geospacial location, geographic features (e.g., based on the location, what is the tree coverage, for example, as determined by satellite imagery), associated HVAC device(s) (e.g., type, capacity, model, etc. of the heating and/or cooling systems/sensors), user demographics, home/commercial implementation, and/or the like. In so doing, ACPLHVAC improves efficiency of learning and provides an overall reduction of processing required to provide comfortable and energy-efficient environments to users. Although ACPLHVAC may be discussed herein in the context of thermostats or other environmental control devices, it is to be understood that the ACPLHVAC and/or ACPLHVAC components can be implemented across a series of thermostats and/or distributed control devices, and/or on a server or servers connected to thermostats/control devices, thereby facilitating actions and increasing efficiencies of the various thermostats and associated systems.

FIG. 1A illustrates example connection types between ACPLHVAC units to perform parallel learning information exchanges. In one embodiment, an individual ACPLHVAC unit may be isolated 102 and perform local reinforcement learning optimizations. In one networked embodiment, units may be linked in a peer-to-peer network to share parallel learning optimizations as illustrated by 104. In another networked embodiment of the ACPLHVAC, a unit may be connected to more generalized information through the internet 106 (and/or other network) that does not necessarily contain specialized information from other units, but can act as a default initial configuration transition function for a new install. In another networked embodiment of the ACPLHVAC, a unit may be connected to generalized information via the internet (and/or other network) and also to shared parallel learning optimizations from other units 108. In another networked embodiment, units may be linked via a client/server connection model with one or more server units proffering requested optimizations to one or more client units 110. In some embodiments, these optimizations may be performed by reinforcement learning on the server units. In some embodiments, these optimizations may take the form of more generalized data, for example environmental or geometric data. In some embodiments, these optimizations may be the result of client units not peer-networked and passed on to other client units serviced by the server unit.

Figure 1B:
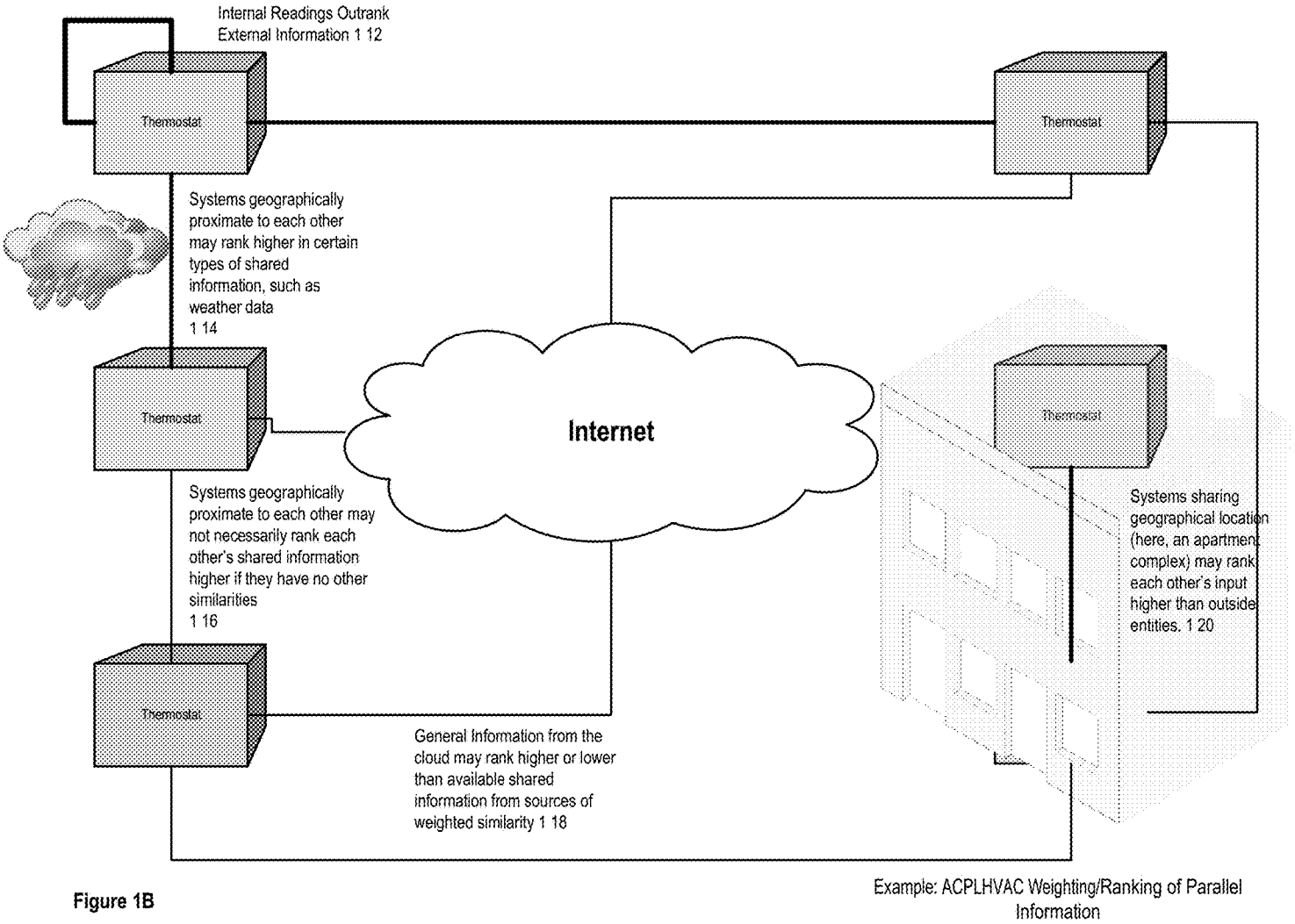
FIG. 1B illustrates example aspects of possible non-exclusive ranked connection types for some embodiments of the ACPLHVAC.

In some embodiments of the ACPLHVAC, shared parallel-learning optimizations may be ranked and/or weighted according to their relevance to the individual unit to which they have been communicated. FIG. 1B illustrates exemplary weighted connections between ACPLHVAC units according to some embodiments. In one embodiment of the ACPLHVAC, the internally generated optimizations may be ranked/weighted higher than shared information from external units 112. In one example, the ACPLHVAC may employ variable ventilation according to the usage of the room, rather than its dimensions or other generalized data about similar rooms from external sources. In some embodiments of the ACPLHVAC, a user or administrator of the unit may be able to adjust how internal optimizations are ranked/weighted against external optimizations. For example, a user may limit shared information from units that are not geographically proximate to this unit, do not share environmental characteristics with this unit, or may isolate the unit completely from shared information sources. In some embodiments of the ACPLHVAC, the unit itself may limit shared optimizations based on its action-selection policy. In some embodiments of the ACPLHVAC, units that are geographically proximate or similar, such as those that are in the same city, state, or biome may rank/weight shared optimizations higher than those that do not share geographic proximity or similarity 114. In some embodiments of the ACPLHVAC, geographic proximity may be discounted if other characteristics of the units are insufficiently similar or if geographic proximity does not lend useful shared data 116, which may include, in some embodiments, weather patterns, temperature modulations, and/or the like. In some embodiments of the ACPLHVAC, units may rank/weight general information from the internet higher or lower, depending on other sources of shared optimizations 118. For example, a unit with little to no peered units or for which peered unit optimizations have resulted in large negative feedback from users applying QoE adjustments, may down rank peered shared optimizations and rely on more general optimizations through the cloud. In some instances of the ACPLHVAC, units that share environmental similarities, such as apartments in an apartment complex or models in a housing or office complex, may rank shared optimizations from fraternal sources higher than those which do not share aspects of their physical environment 120. In one instance of the ACPLHVAC, demographic information of occupants may be used to determine shared optimizations across spaces, such as age compatibility. In some instances of the ACPLHVAC, units may be pre-loaded with state space specifics, such as information about the size and shape of the space, buildings of similar specifications, occupancy background and size, historical data and/or the like. In some instances of the ACPLHVAC, units may contain no pre-loaded information. In some embodiments of the ACPLHVAC, information about the space may be determined by sensors in the environment and/or on the unit.

Figure 1C:
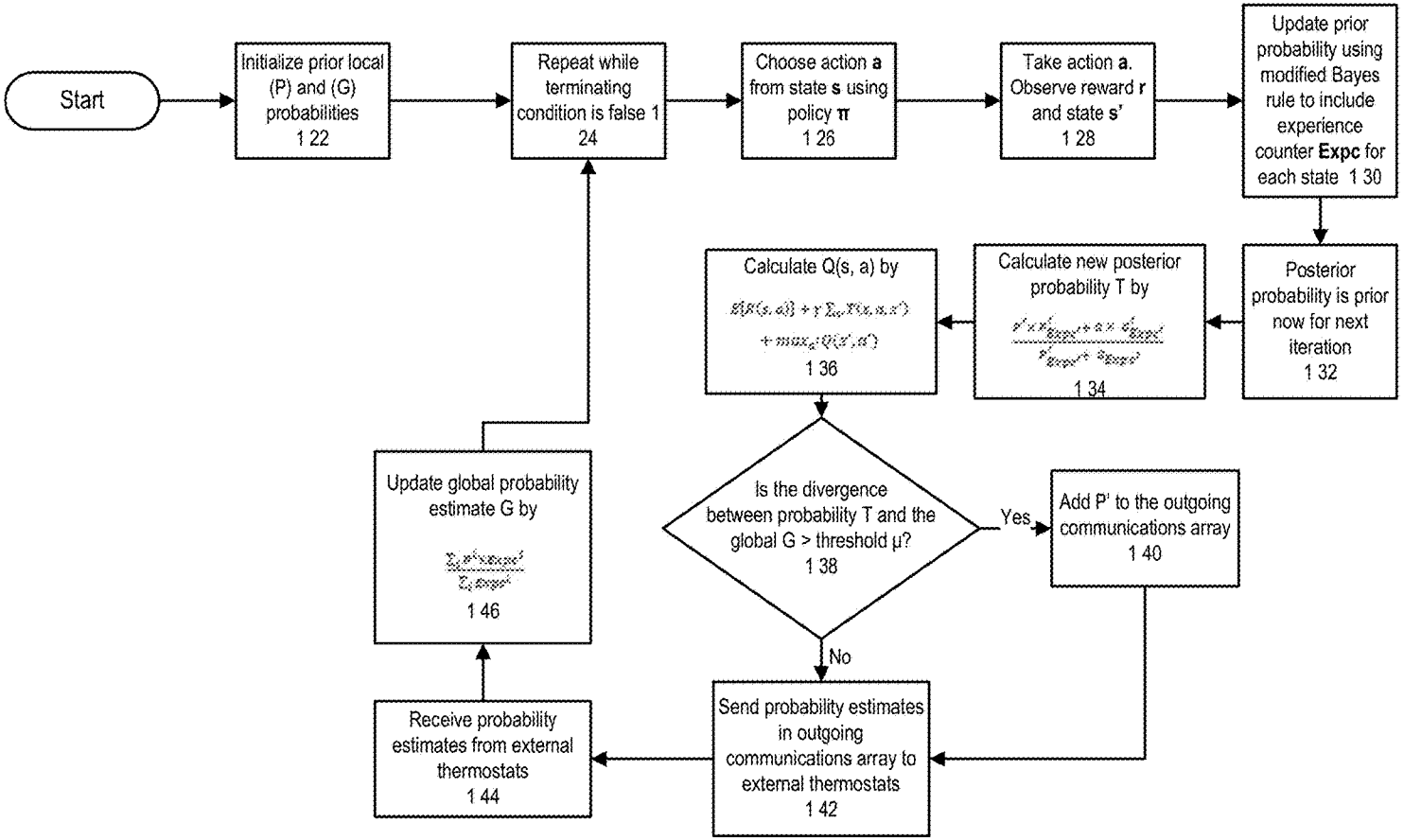
FIG. 1C shows a logic flow diagram illustrating an example non-symmetric probability divergence component for determining differences in probability distributions among some embodiments of the ACPLHVAC according to some embodiments of the ACPLHVAC.
Figure 5:
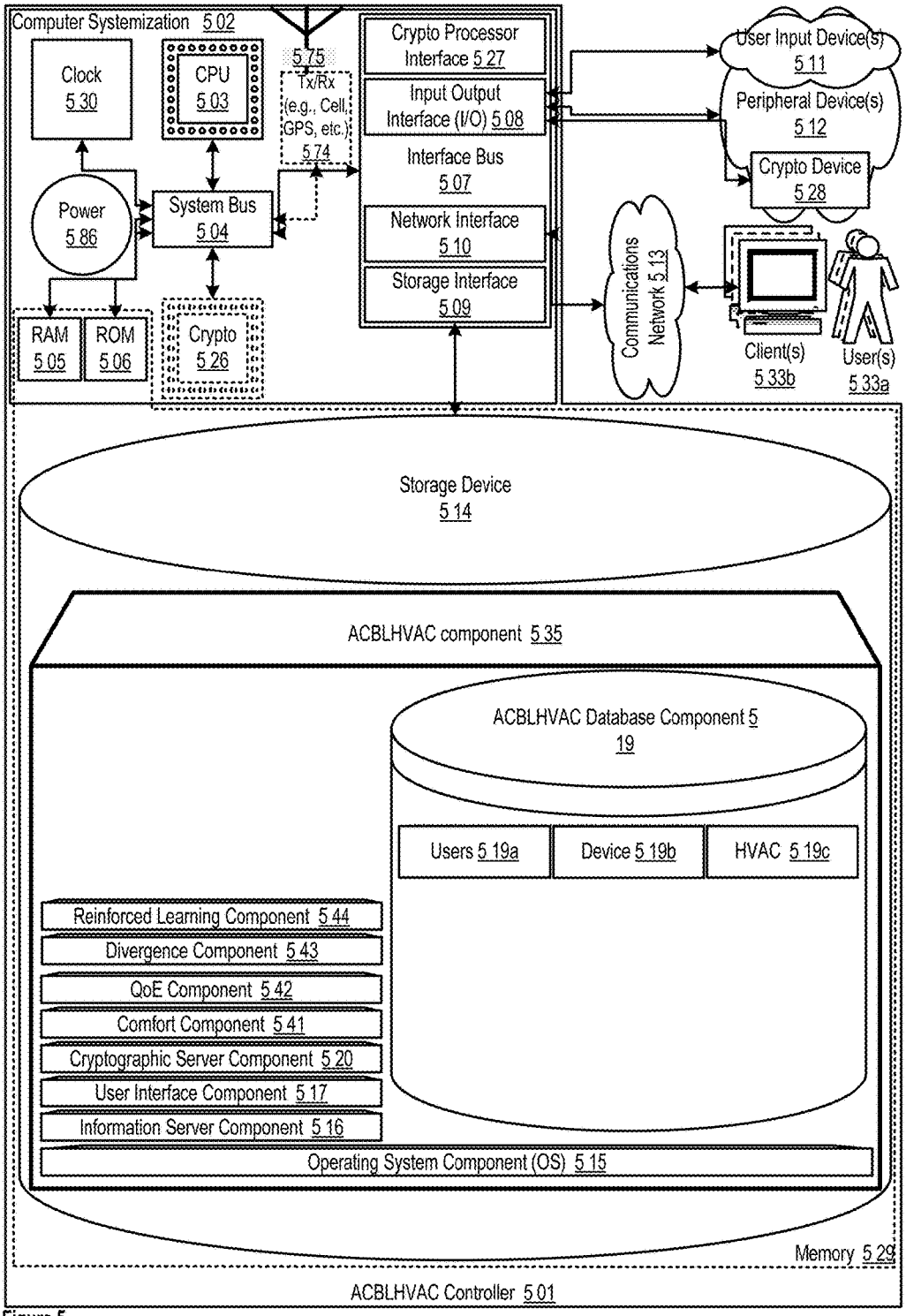
FIG. 5 shows a block diagram illustrating embodiments of a ACPLHVAC controller.

One example of how an ACPLHVAC unit may determine its similarity to optimizations shared by parallel learning sources such as peered external units, servers, the cloud, and/or the like is through a divergence component 543 (as shown in FIG. 5 and discussed below), utilizing a non-symmetric mechanism comparing probability distributions resulting in a distance variable, such as, by way of non-limiting example, Kullback-Liebler Divergence. In this embodiment, a unit begins by initializing both local and global probability sets to zero before reinforcement learning and shared learning occur 122 (as illustrated in FIG. 1C).

% Define transition function, both local and global T(s, a, s')
T(nStates,nActions,nStates)=1/nStates; % Transition probability—Also acts as posterior probability
T_global=T; % Global transition probability
P=T; % Prior probability
comms_in=zeros(T, agentNum);
comms_out=zeros(T);

While a terminating condition has not been reached (in this embodiment, a terminating condition may constitute the execution of a set number of "epochs" or discrete time units, a continually low divergence over a set of checks, a manual or automated shut off of optimization sharing among units, and/or the like) 124, the unit chooses an action from its current state space using an action selection policy 126. The unit can be "rewarded" (in this embodiment, reward denotes feedback in the form of a positive or negative scalar value) for its choice and transitions to the next state 128. Its prior probability is updated to those from before the state change 130 and posterior probabilities become the priors for the new state 132. A new posterior probability is calculated for the next state transition 134. The unit calculates the value of transitioning from a series of states given a specified action 136. Here, the unit then compares its independently learned transition probability with that of the collected probabilities from global sources (such as peered units, server units, cloud information, and/or the like) to determine their divergence.

% Calculate the transition probability, by combining local and global $$T=((P*l\text{ExperDash}(\text{stateIndex},a))+(T_\text{Global}*g\text{ExperDash}(\text{stateIndex},a))/(l\text{ExperDash}(\text{stateIndex},a)+g\text{ExperDash}(\text{stateIndex},a));$$

% Compute the Kullback-Liebler divergence
distance=KLDiv(T,T_global);

In this embodiment, if the divergence of the two probability distributions is greater than some predefined threshold μ (such as $10^{-4}$) 138, the unit's transition probability is added to the outgoing communications array 140 to be shared in parallel with additional units that may be requesting shared optimizations in any embodiment 142. This can provide for efficient bandwidth usage and allocation by reducing the amount and/or frequency of communications. In some embodiments, depending on the implementation, the predefined threshold may be modifiable by the unit, a user, an administrator of the system, and/or the like. In some embodiments, divergence between probability sets may not be considered when determining shared optimizations.

Quality of Experience (QoE) denotes a user-subjective measurement of the comfort level of their environment. Unlike other learning systems which adjust based on user-defined setpoints or pre-programmed schedules, the ACPLHVAC allows users to take a QoE assessment of their environment, independent of state space variables such as temperature, humidity, and/or the like, for example, utilizing a QoE compent 542 and/or comfort component 541 (as shown in FIG. 5 and discussed below). Systems may attempt to maintain specific state space setpoints, for example a set temperature, while also adjusting HVAC responsiveness in predefined ways to maximize efficiency (for example, regulating blower speed, etc.) based on known energy costs of equipment. In some embodiments the ACPLHVAC allows users and/or administrators to define state space setpoints, but can also specify interfaces that allow users to quantify their comfort level in an environment and adjust HVAC operation based on comfort level, potentially ignoring or minimizing setpoint criteria. Unlike setpoint-adherent systems which cannot incorporate multiple setpoints in a single unit (for example, a unit set to multiple temperatures is nonsensical), the ACPLHVAC can allow multiple users to quantify their comfort level in QoE and aggregate those scores into a Mean Opinion Score (MOS). In such an embodiment, an ACPLHVAC unit can collect QoE data from all occupants of a space and maximize comfort level for the group, rather than an individual.

Figure 2A:
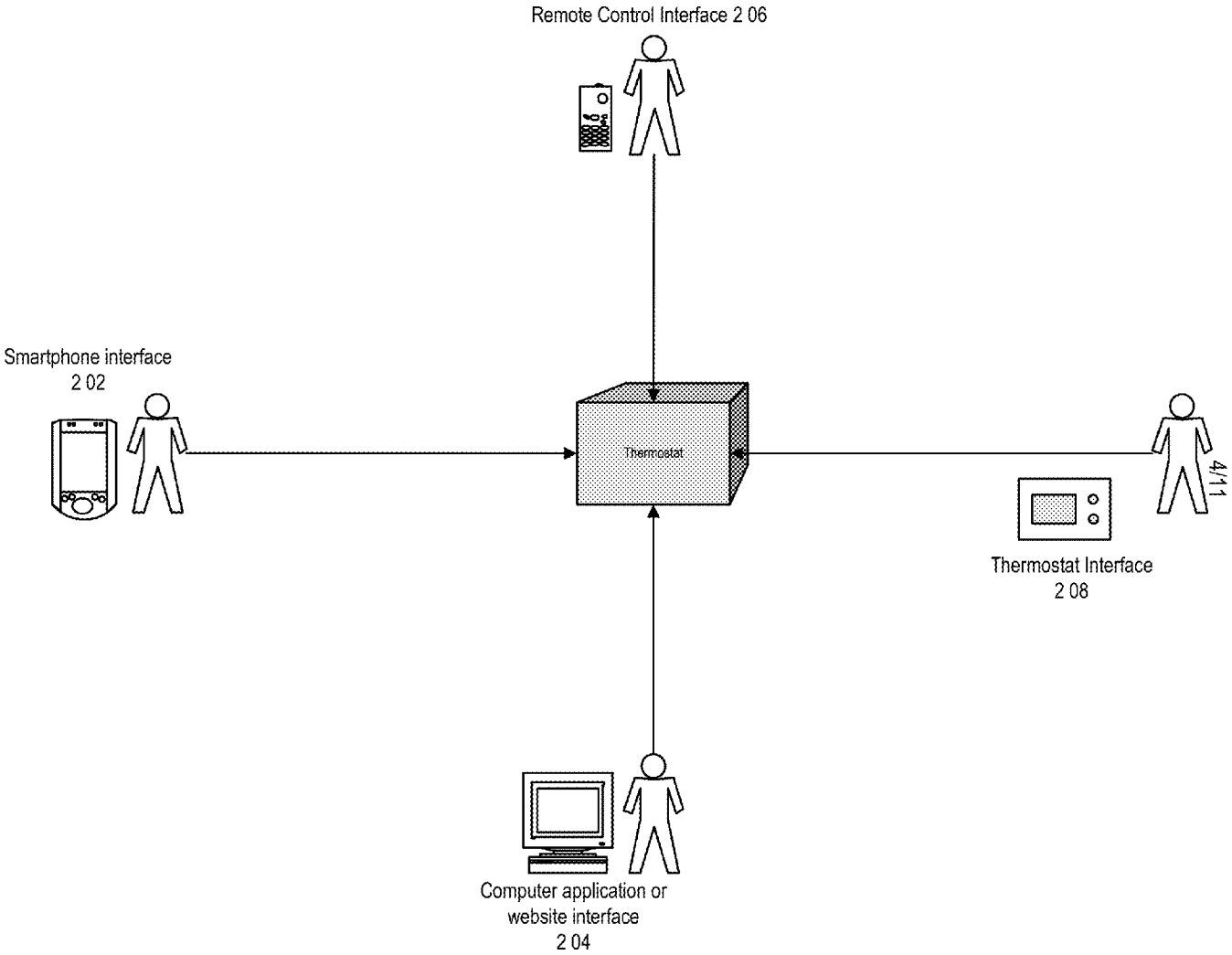
FIG. 2A shows some examples of possible human-directed Quality of Experience (QoE) interactions with the ACPLHVAC according to some embodiments of the ACPLHVAC.

FIG. 2A shows some embodiments of possible interaction methodologies for users supplying QoE data to the ACPLHVAC. In one embodiment, a user may interact with a smartphone application to adjust their QoE 202. Additionally or alternatively, the user may interact with a computer application or website to rate their QoE 204. In some embodiments, a user may interact with a remote control designated for the unit 206 to rate their QoE. In some embodiments, the user may interact with the unit itself (i.e., a thermostat) to rate their QoE 208. In some embodiments, more than one user may interact with any or all of these interfaces either sequentially or in parallel to adjust their QoE. In those embodiments in which multiple users are rating their QoE through a plurality of interfaces, the unit may aggregate their QoE ratings into a MOS.

FIG. 2B shows some possibilities for interfaces assessing a user's QoE. In one embodiment, a smartphone application interface shows the current temperature and/or setpoint temperature, the time, buttons to adjust the setpoint temperature and radio buttons to quantify QoE 210. In one embodiment, a computer application and/or website interface shows the unit, its current temperature and/or setpoint and the time, with buttons to adjust the setpoint temperature and a sliding bar to quantify QoE 212. In another embodiment, a remote control paired to the unit shows the current setpoint and/or temperature and has buttons to adjust the setpoint and to assess the user's comfort level 214. In one embodiment, the unit shows the current setpoint and/or temperature and time, and has buttons to adjust the setpoint and record the user's current comfort level 216. In these embodiments, the QoE is rated on a discrete scale of through 5, with 1 being the most uncomfortable and 5 being the most comfortable. In some embodiments, the QoE scale may incorporate a wider band of possible options. In some embodiments, the QoE scale may be analog rather than discrete, allowing for fractional divisions between whole number comfort levels.

Because QoE is a subjective measure and does not require preprogramming or forethought on the part of the user (unlike a setpoint, which requires the user to determine the desired temperature in advance of the HVAC adjusting to meet that temperature), the ACPLHVAC provides improvements in both user satisfaction and energy efficiency. In manual and preprogrammed systems, users are unlikely to modify the controls once they have been set, leading to large inefficiencies in HVAC usage such as times when the space is unoccupied. Some HVAC systems have improved over these large inefficiencies but still pursue the setpoint input. A misadjusted setpoint system can cause the HVAC to run unnecessarily, wasting its associated energy costs. Even a deliberate user setpoint may not reflect the user's true opinion of the area's comfort level, as it must be chosen in advance and modifying the setpoint to a true comfort level would require constant minute adjustments on the user's part in a sort of educated guessing game as to which setpoint will accurately reflect the desired level of comfort. With the ACPLHVAC, QoE assessment through a multitude of interfaces allows users to accurately rank how comfortable they are feeling in a discrete moment. This also allows users to move through a number of comfort settings over the course of a day, to reflect how they are feeling in response to activities or stimuli (for example, a user may return to the environment after exercising and prefer cooler conditions. Later in the day, as their internal temperature returns to normal, they desire to warm the environment again). In one embodiment, the ACPLHVAC may automatically adjust itself in response to these inputs in real-time. As multiple users may signal their QoE to the ACPLHVAC, the ACPLHVAC can make adjustments to reflect the aggregated MOS of all users relaying QoE inputs to the unit.

An additional advantage to the QoE method over traditional setpoint adherence is the ability of the ACPLHVAC to balance state space variable adjustment (such as temperature, humidity, and/or the like) with associated energy costs (such as fuel, equipment wear/tear, and/or the like). FIG. 2C is a hypothetical table showing a simplified state space of temperature against the energy cost of maintaining that temperature and the reported MOS of user(s) in the environment 218. In this embodiment, the MOS of 22° C. and 23° C. is differentiated by 0.04 and represent the highest comfort level scores of the chart. In some instances, the ACPLHVAC may be adjusted by the user or an administrator to give different goals more weight through its reinforced learning reward system. In some instances, user comfort level may be weighted more heavily than energy cost. In some instances, energy costs may be weighted more heavily. In some instances, other factors such as season, environment, demographics of occupancy, and/or the like may be weighted by the system. In some instances, all these weights may be adjustable both prior to and during ACPLHVAC operation.

In the example of FIG. 2C, the ACPLHVAC may be adjusted to seek a minimized distance between associated comfort levels and monetary cost. In this embodiment, a difference in comfort levels of 0.04 may be considered less significant than the difference in energy or monetary cost of $20 between room temperatures 220. The ACPLHVAC may weight the monetary cost more heavily and receive a negative reward for attempting to adjust to the highest MOS at this additional cost. The ACPLHVAC may then adjust the temperature down to the second highest MOS to achieve energy efficiency and cost savings. In some embodiments, as exemplified by FIG. 2C, a threshold MOS may further improve energy savings. If the ACPLHVAC unit were to weight achieving a certain MOS threshold, such as 3.5 as sufficient, it could adjust to the 24° C. temperature for additional energy cost improvement and a comfort level above the threshold.

Figure 3:
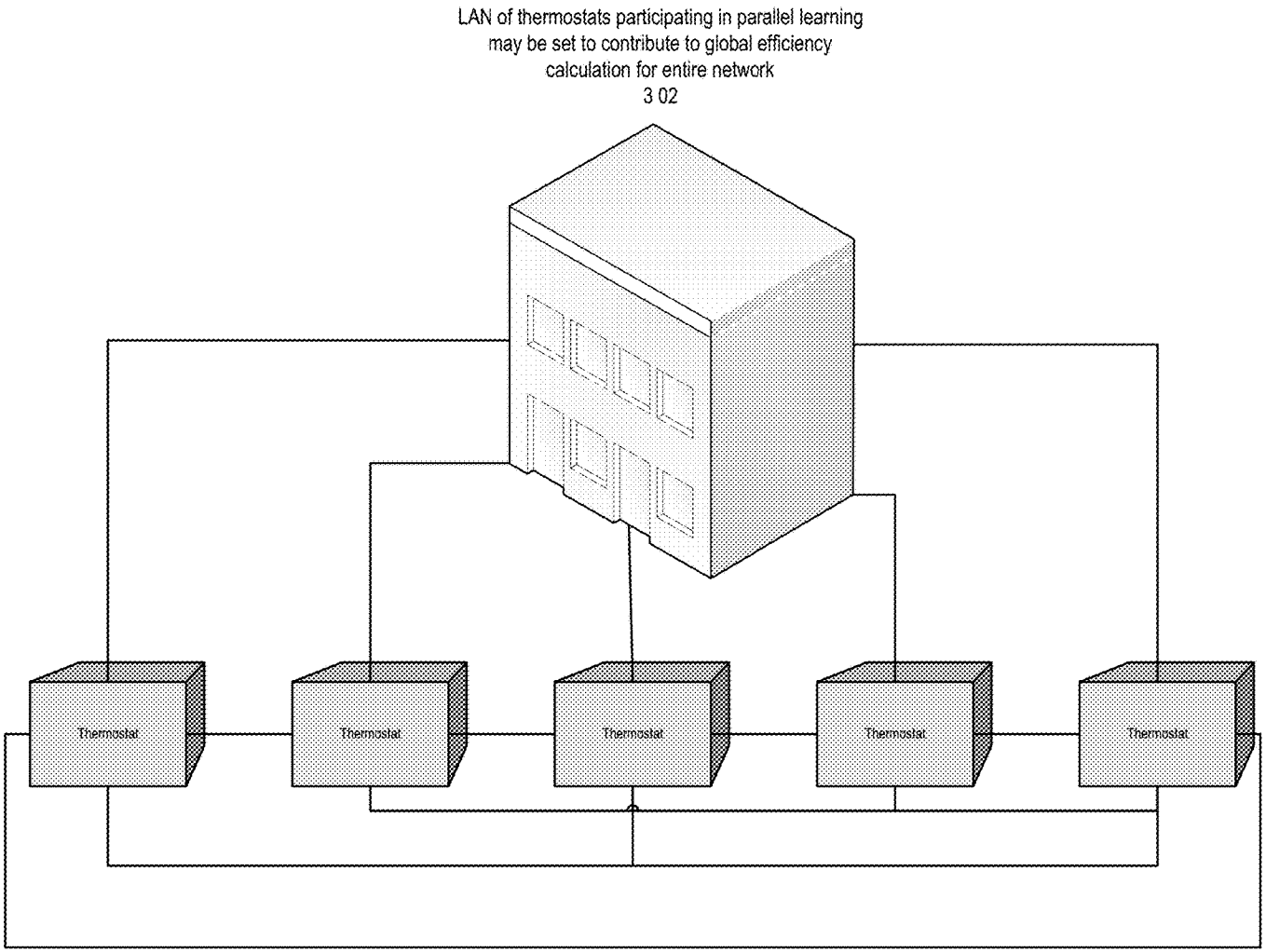
FIG. 3 shows a diagram illustrating example aspects of parallel learning contributing to the efficiency of an area block in some embodiments of the ACPLHVAC.

The parallel learning architecture of the ACPLHVAC allows for additional efficiency/cost/energy/comfort considerations to be made across an entire area of networked units. Unlike thermostats which work in isolation and attempt to improve on energy costs exclusive to a singular HVAC system which they control, the ACPLHVAC allows associated units to share optimization information and potentially pursue a unified policy for implementation. FIG. 3 shows an embodiment of networked units inside a building. In this embodiment, a unified policy of energy efficiency for the building may be pursued by all units, using reinforcement from their shared optimizations, even as they operate multiple HVAC systems at once 302. Alternatively or additionally, the unified policy may be implemented only at certain times and/or for certain units (e.g., implemented only during certain time(s) of day). The ACPLHVAC incorporates the aggregation of learned probabilities to be transmitted to all devices simultaneously, developing a shared policy. In some instances, the policy may be explicitly set by users or an administrator. In some instances, the policy may be spontaneously developed through reinforcement learning strategies. In some embodiments, this may be combined with pre-loaded environment information, such as described earlier.

In some embodiments of the ACPLHVAC, individual units are accorded an action space based on operation of their associated HVAC systems. In some embodiments, these actions may be as simple as turning on or off the heat. In some embodiments, these actions may include humidity adjustment, air conditioning control, and/or the like. An ACPLHVAC controller may take any of these actions accorded to it in its action space at the end of any defined discrete time interval ("epoch"). Determining which action to choose at the end of each epoch is the fundamental operating procedure of the unit. A reinforcement learning component or algorithm is appropriate to the question of which action to take as it will over time approach an optimal policy for an environment the longer it operates there and receives internal and external feedback.

Figure 4A:
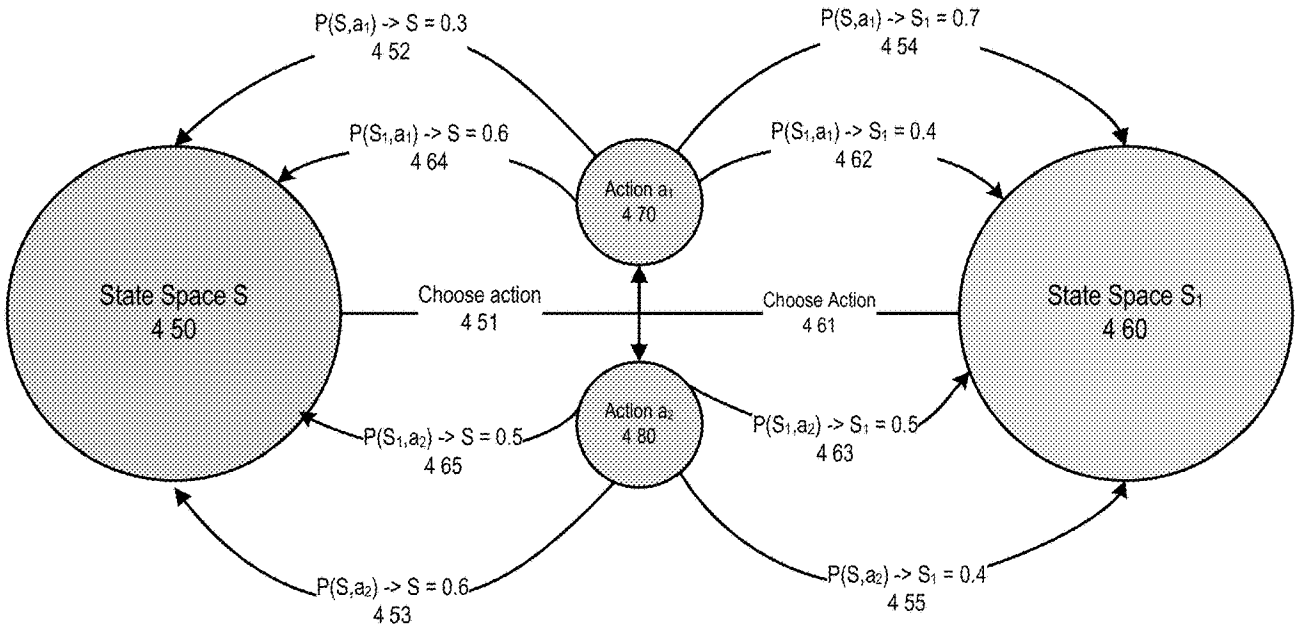
FIG. 4A shows a state diagram illustrating one embodiment of a two state two action Markov Decision Process according to some embodiments of the ACPLHVAC.

FIG. 4A illustrates a two state finite Markov Decision Process with no external influence, as an example of one embodiment of a reinforcement learning process. In this embodiment, the agent can reside in one of two possible states at any given time S 450 and $S_1$ 460 from which there are two possible executable actions $a_1$ 470 and $a_2$ 480. If the element begins in state space S and executes action $a_1$, there are two possible outcomes: that it will return to S or that it will transition to $S_1$. In this embodiment, the probability that it will remain in state S after choosing action $a_1$ is 0.3 (with 0 being no probability and 1.0 representing absolute certainty) 452 and the probability that it will transition to $S_1$ after choosing action $a_1$ is 0.7 454. Thus it has a 70% likelihood of transitioning from itself to $S_1$ executing $a_1$. Executing $a_2$ results in 0.6 probability 453 it will remain in S and a 0.4 probability 455 it will transition to $S_1$. In this embodiment, it is acceptable to return to the current state having executed an action. In some embodiments, it may also be acceptable to remain in the current state. For example, a ACPLHVAC unit may execute the action Heat Off at the end of an epoch where the heat has already been off. In this example, this would be an acceptable action for the unit to take and would render the unit's current state unchanged.

If the element does transition to state space $S_1$, the next iteration will allow it to select from the same set of actions. Choosing $a_1$ results in a 0.4 probability 462 of retaining $S_1$ and a 0.6 probability 464 of transitioning to S. Choosing $a_2$ results in a 0.5 probability 463 of remaining in $S_1$ and 0.5 probability 465 of transitioning to S.

This embodiment where a state action space formalism drives the ACPLHVAC's environmental interactions may be stationary (the probabilities of transitioning between states is fixed) or non-stationary (they may change over time). The reward signal indicates the benefit to the learner of choosing particular actions while in particular states. The goal of the reinforcement learner is to repeatedly choose actions based to maximise reward.

Figure 4B:
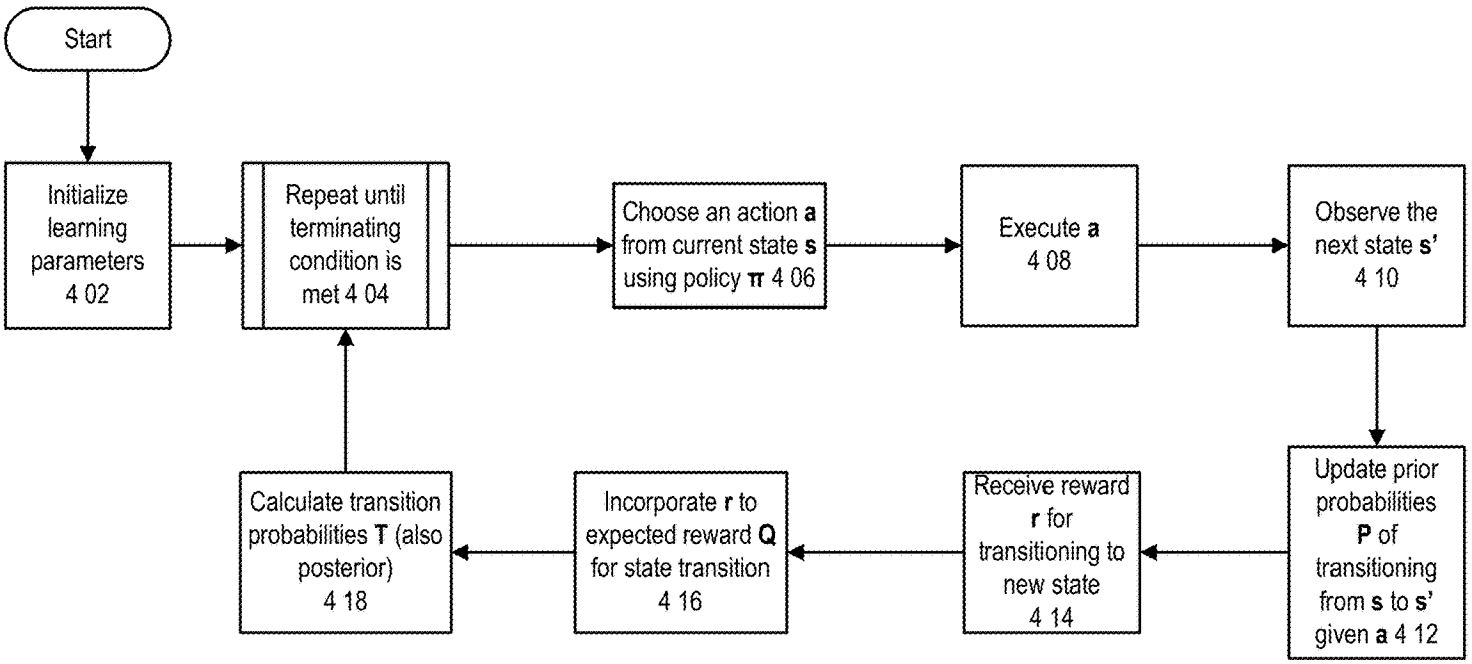
FIG. 4B provides a logic flow diagram illustrating an example isolated reinforcement learning component or algorithm maximizing QoE while minimizing energy costs according to some embodiments of the ACPLHVAC.

FIG. 4B illustrates one embodiment of a reinforced learning component for an isolated (non-networked) unit. In this embodiment, the unit may or may not be pre-loaded with information about its environment, as the presence of initializing information does not affect the logic flow of the learning strategy. In this embodiment, the component (and/or algorithm) initializes its learning parameters, either with pre-loaded information or initialized with arbitrary values 402. It can repeat until it has met a termination condition, which may be a time limit, a number of iterations, a comfort level, a user-defined stopping point, a too-small differentiation between probability sets and/or the like 404. The unit begins in a state s that may include such things as the current time, the current temperature, a setpoint temperature, a setpoint humidity, a time to the setpoint, if the heat is on, if the heat is off, the MOS of occupants, and/or the like:

% A state space s {time, temperature, humidity, sp temperature, sp
% humidity, time to temperature, heat on, heat off, MOS}
s={10:05, 19, 38, 21, 40, 10, false, false, 3.5}

The unit can choose an action a (in this embodiment the action space is defined as {turn heat on, turn heat off}) to execute using a policy π 406 and executes that action 408.

% Returns the action for the epsilon greedy policy
a=getEpsGreedyDecision(epsilon, stateIndex);
% Method executes the chosen action i.e. Heat on or off
executeAction(a);

It observes the value of the next state s' which is generated executing the action 410.

% Observe s' the next state
currentTemp=getTempReading( ) % Returns reading from thermostat sensor
timeToOccupancy=getTimeToOcc( ) % Function returns the predicted time to occupancy in minutes
nextStateIndex=getStateIndex(currentTemp, timetToOccupancy);

Update the prior probabilities matrix associated with transitioning from s to a new state, given a 412.

% Update the probability of each action resulting in a transition to the next state for si=1:nStates
if(si==nextStateIndex)
P(stateIndex,a,si)=(P(stateIndex, a, si) (lExperDash (stateIndex,a))+1)/lExperDash(stateIndex, a);

```
else
  P(stateIndex,a,si)=(P(stateIndex, a, si) (lExperDash
    (stateIndex,a))/lExperDash(stateIndex, a);
end
```

Transitioning to s' results in a reward (which may be positive or negative) 414.

```
% Compute the reward based on state and action
% There are 7 rules which define the reward allocated to the
learner
if((currentTemp<setPoint)||(currentTemp>setPoint) &&
(a==1) && (isRoomOccupied( )==false))
reward=-1;
end
if((currentTemp<setPoint)||(currentTemp>setPoint) &&
(a==1) && (isRoomOccupied( )==true))
reward=-3;
end
if((currentTemp<=setPoint)||(currentTemp>=setPoint) &&
(a==1) && (isRoomOccupied( )==false))
reward=-1;
end
if((currentTemp<=setPoint)||(currentTemp>=setPoint) &&
(a==1) && (isRoomOccupied( )==true))
reward=-1;
end
if((currentTemp<setPoint)||(currentTemp>setPoint) &&
(a==2) && (isRoomOccupied( )==false))
reward=0;
end
if((currentTemp<=setPoint)||(currentTemp>=setPoint) &&
(a==2))
reward=0;
end
if((currentTemp<setPoint)||(currentTemp>setPoint) &&
(a==2) && (isRoomOccupied( )==true))
reward=-3;
end
```

The value of performing the given action is calculated from the reward, the expectation of what reward should be received, and a weighting of future rewards 416.

```
for i=1:(x-1)
  % Update Q function estimate
    Q(stateIndex,a)=reward+gamma*(T(stateIndex,a,pos-
      sibleFutureStates(i))*max(Q(possibleFutureStates
      (i)), [ ], 2));
  end
```

Posterior transition probabilities are calculated and stored 418, after which the process or algorithm repeats unless the terminating condition is met.

```
% Calculate the transition probability
```

$$T=((P*l\text{ExperDash}(\text{stateIndex},a))/(l\text{ExperDash}(\text{stateIndex},a)+g\text{ExperDash}(\text{stateIndex},a));$$

Figure 4C:
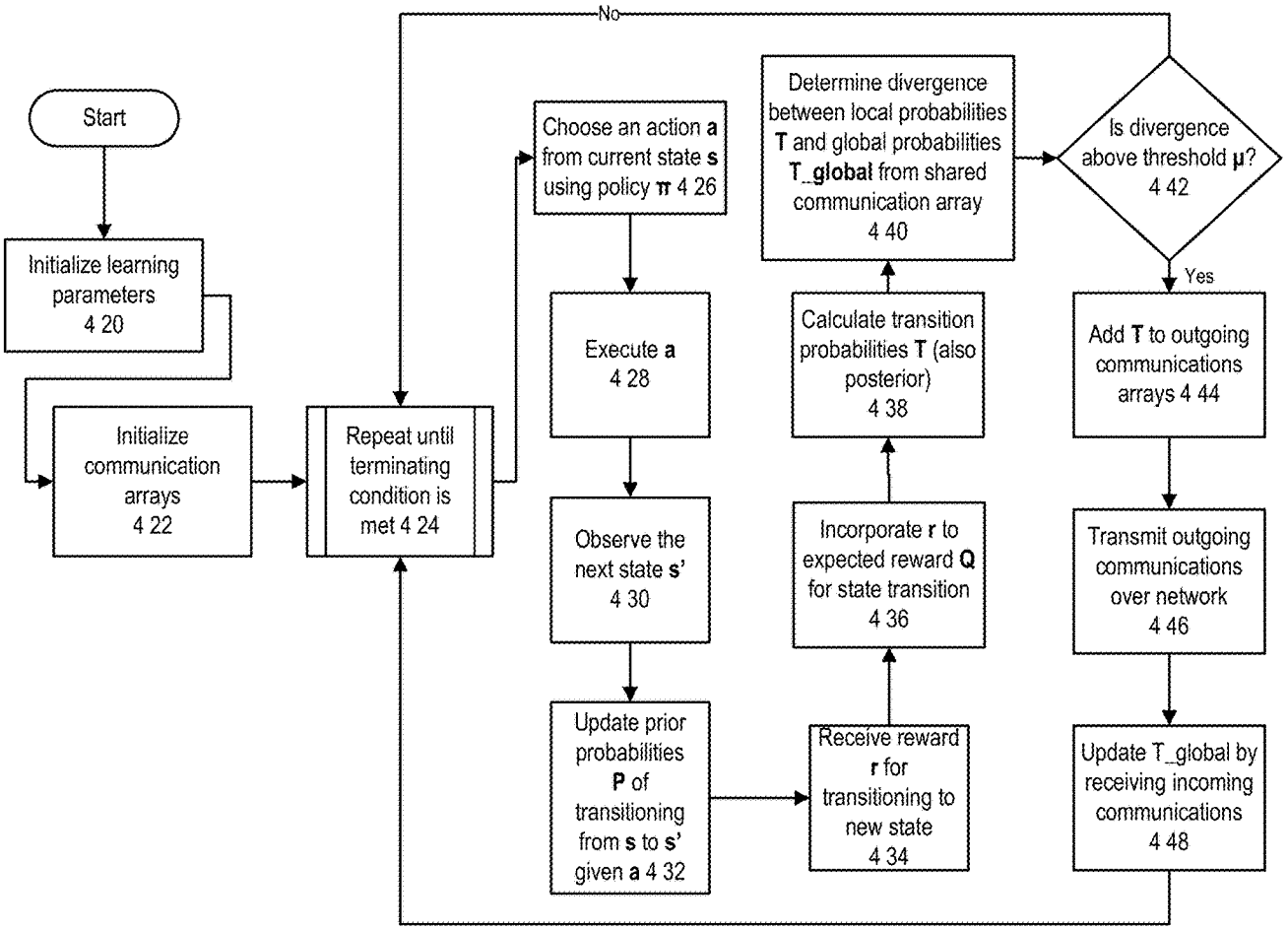
FIG. 4C shows a logic flow diagram illustrating an example connected parallel reinforcement learning component or algorithm maximizing QoE while minimizing costs across embodiments of the ACPLHVAC according to some embodiments of the ACPLHVAC.

FIG. 4C illustrates the same reinforcement learning component and/or algorithm for a connected ACPLHVAC unit that incorporates shared optimizations. In this embodiment, after initializing standard learning parameters 420, the ACPLHVAC initializes incoming and outgoing communication arrays 422 for sharing its probabilities and receiving probabilities from any connected resource, such as peered units, the cloud, servers, and/or the like.

The component (and/or algorithm) selects an action a 426 to perform 428 based on its current state 430 and updates its prior probabilities for transitioning to a new state based on a 432. A reward Q 434 can be received based on its action and the component/algorithm integrates the reward into the value of having performed that action a 436. After calculating the posterior transition probabilities I, the component/algorithm incorporates external optimizations 438.

```
% Calculate the transition probability, by combining local
and global
```

$$T=((P*l\text{ExperDash}(\text{stateIndex},a))+(T_\text{Global}*g\text{ExperDash}(\text{stateIndex},a))/(l\text{ExperDash}(\text{stateIndex},a)+g\text{ExperDash}(\text{stateIndex},a));$$

The component/algorithm determines if the divergence 440 between its local probability matrix and the global (external) probability matrix is above predefined threshold μ 442, as discussed above. This can advantageously reduce the bandwidth utilized and/or processor time utilized. If the divergence is indeed above the threshold, in this embodiment the unit's probability matrix is added to the outgoing communications array 444 and transmitted to networked units and/or the like 446.

```
% Compute the Kullback-Liebler divergence
distance=KLDiv(T,T_global);
if(distance>mu)
  comms_out=T;
  transmitTransitionFunction(comms_out); % Transmit
    local transition probabilities end
```

The component/algorithm finishes its current iteration by receiving new external shared optimizations to use in the next state transition 448.

```
% Update Global, receive estimates
comms_in=getAgentTransitionFunctions( )
% Update the global transition estimate, for the next
timestep
T_global(stateIndex,a,nextStateIndex)=aggregateTransi-
tionProbabilities(comms_in);
```

The above-described process may be iterated or repeated until a terminating condition is met 424. An exemplary reinforced learning component 544 is shown in FIG. 5, and may be configured as discussed in reference to FIG. 4B and/or FIG. 4C.

In some embodiments, ACPLHVAC autonomously controls a HVAC system such that it consumes energy only when required by its users. It is configured to automatically learn a heating and cooling policy based only on observations such as when a person turns on or off the system or based on a Quality of Experience metric. It makes use of available sensory information in a progressive manner, which means that if only a set point denoting the desired temperature/humidity conditions, user feedback (individual turning on and off the controller) and temperature/humidity sensors are available then this is sufficient to learning a control policy.

As additional sensory information becomes available, such Passive Infrared sensors/acoustic sensors to sense occupancy, light sensors to detect ambient light and additional non-sensory information such as information available from open data sources (weather and calendar specific information for meeting room bookings), including user specific information, such as the age profile, demographic and region of the users, the ACPLHVAC will utilize the information to improve the learning mechanism even further. The ACPLHVAC can be, in some embodiments, configured to operate on a constrained device with limited memory and processing capabilities through a number of innovative features. Firstly the aforementioned progressive processing of sensory information allows the ACPLHVAC (and/or associated learning component) to operate under a number of different modes depending on the constraints of the system. In scenarios where processing and memory capacity are at a premium, a simple model of the environment can be used, for example, a temperature/humidity set-point, the current temperature/humidity and UTC time of when the user turns on and off the device. Secondly, the ACPLHVAC can utilize a knowledge sharing mechanism and/or parallel learning component where information is shared amongst individual controllers removing the need to learn completely independently each time, resulting in shorter times to learn a control policy (i.e. when it is optimal to turn on and off the heating/cooling).

The ACPLHVAC can also be configured to automatically turn on and off HVAC that consumes energy only when required by users. Heating and cooling systems need to be operational for some time before a room is occupied as spaces do not change temperature instantly due to the thermal inertia of the building. It is more inefficient due to wear and tear and from an energy perspective to switch heating or cooling systems on and off if a space is being used sporadically, say from 18:00-19:00 and from 19:30 to 20:00 than it would be to leave them on over that time period. Turning HVAC systems on and off frequently is not efficient as the money that is saved during the OFF time can be offset by the large current draw required for starting up the large fan and the on and off cycles can require more maintenance on the motor belts and other equipment.

To address this, the ACPLHVAC can calculate the run-time remaining based on previous usage. In simple terms, this constitutes as to how long the system estimates that heating and cooling will run for based on the current time and its value functions, which can be considered its internal probabilistic model of an event occurring. The system has two competing goals, occupant comfort which is manifested through a Mean Opinion Score and cost minimisation, where the system aims to save the user as much money as possible through efficient controlling of the system. The cost function is an estimate of energy consumption per unit time that the system is operational, i.e. heating and cooling the space. This can be estimated using open data sources such as up to the minute Kwh costs per unit or by the user entering cost information regarding the system on a periodic basis i.e. each time they receive a bill from their utility company. Using this information the system can also predict what the costs a likely to be, given current usage and inform the user as to the predicted costs through simple arithmetic operations based on the actual costs previously observed.

The ACPLHVAC is configured to avoid causing unnecessary inconvenience for room occupants. The ACPLHVAC can allow for the unplanned use of spaces by allowing users to override the system to switch on and off the HVAC system at any time. The ACPLHVAC can also utilize user overrides as a reinforcement with regard to occupancy comfort, that is, if the system has already shut down the heating and cooling based on previous estimates and the user overrides this, the ACPLHVAC interprets this as a negative reinforcement and updates its estimates accordingly. The ACPLHVAC can take as input the planned usage of a space based on past observations. In the beginning when there is no information about past usage it will turn on heating and cooling systems according to the overall schedule for the room by the users according to a method that uses the system to maximum efficiency, only having it on when required while not switching it on and off unnecessarily requiring more energy or wear and tear than actually leaving them on. If information is available from other controllers in the system, this information can be automatically transferred as to the new controller and forms part of its model of the environment.

The ACPLHVAC can provide user-driven control—unlike typical systems where HVAC controller owners control the system, the ACPLHVAC learns through normal usage of the system without any additional work on their behalf.

The ACPLHVAC can also provide variable ventilation functions. Where other systems have a fixed ventilation set up, usually according to the volume of the room and the number of participants that are likely to use it, the ACPLHVAC can ventilate the space according to the usage of the room and the number of participants. If the room is a meeting room this information could be garnered from enterprise data sources such as groupware booking systems for rooms. Occupancy sensors could also determine the existence of people within a space.

Embodiments of the ACPLHVAC are configured to learn an optimal or improved control policy in an online manner through direct environmental observations. Thus the ACPLHVAC is not domain specific and is capable of learning this optimal policy agnostic to the environment within which it is placed. Thus, the same implementation of ACPLHVAC can, in some embodiments, work for all types of rooms across a range of buildings, needing access only to simple state information to determine the appropriate HVAC action each time. This improves dramatically upon existing solutions that may require domain expertise, such as the room square footage, number of windows and doors to optimize the schedule. Relying on domain knowledge is bound by the skill and accuracy of the individual programming the system. This can often prove non-trivial as it may be difficult to determine the heating/cooling effects achievable as a function of the number of room variables, such as windows, doors, ventilation ducts, climate, etc.

The ACPLHVAC may also be configured for anomaly detection, such that observations over date and time allow the ACPLHVAC to detect anomalies in heating and cooling for a given environment. These may be seasonal adjustments resulting in different weather conditions which require different actions or it may also be a function of other external events within the building, such as the changing conditions of other rooms in the vicinity. These anomalies can be elegantly addressed by the ACPLHVAC as it can associate the environmental state with changing room conditions and take actions accordingly.

The ACPLHVAC may also be configured with adaptive thresholds, employing a system of adaptive and proportional thresholding which offers a gradient solution towards achieving the respective set point (e.g., temperature and/or humidity) at a minimal energy cost.

The ACPLHVAC may also be configured for cost vs comfort optimization. The ACPLHVAC supports trade-off between occupant comfort and cost minimisation, where it reduces the cost by pushing the boundaries of occupant comfort. This can be determined by the negative reinforcements it receives from the user. For example the ACPLHVAC may choose to reduce the temperature on a heating cycle based on similar settings for other properties in the vicinity. This should result in a cost saving but if the user interrupts the process and increases the temperature this is seen as large negative reinforcement and the system is unlikely to take a similar course of action again.

Embodiments of the ACPLHVAC also support a domain dependent convergence speedup via utilizing available domain expertise. One embodiment would include define an initial heating/cooling policy at the beginning of the learning process. As learning progresses, the ACPLHVAC improves upon this policy and optimizes it further. Whilst not strictly a requirement in all embodiments, such a feature can improve the initial learning time for the ACPLHVAC and remove a large number of the exploratory actions likely to be undertaken.

In some embodiments, the ACPLHVAC learns in a discrete time environment by observing the environmental state at different instances in time. This can be understood as the heating/cooling state action space formalism. The specifics of the h/c formalism include the set of states, actions, rewards and transition functions. Details of all of these parameters are discussed above.

The ACPLHVAC provides strategic awareness with respect to energy costs, achieving energy savings over existing approaches as it employs a multi-criteria optimization technique embodied as a model based reinforcement learning component/algorithm to make control decisions. Previous approaches have focused on optimizing to a single functional requirement such as the temperature/humidity set point without considering the costs.

Rather than operating myopically, the ACPLHVAC instead chooses actions which yield the greatest value in the long run. This means that the ACPLHVAC may forgo short term gains to realize greater energy savings in the long run, and can be for a particular unit or across a plurality of associated devices (such as in an office building).

The ACPLHVAC provides an efficient solution for learning about a specific domain as existing controllers within the locale can inform the operating controller as to how the environment will respond to its actions even before it has observed anything itself. The information can be used to form the basis of an effective or efficient initial policy which reduces significantly the amount of learning required.

The ACPLHVAC can operate without requiring expensive sensor installations by utilizing information currently available to it. This is because it can learn a simple control policy by using only basic information, such as current temperature/humidity, set-point and UTC time when HVAC system is operational.

The ACPLHVAC supersedes previous methods published for model free learners such as Q-learning, SARSA, and the like, as it can use environmental observations to approximate the missing model and then solve using dynamic programming methods. This can be advantageous relative to model free methods with respect to accuracy but comes a cost with regard to computational constraints. To maintain the accuracy of the method but keeping it suitable for running on a constrained system, the ACPLHVAC utilizes parallel learning to provide a superior solution.

While operating on constrained devices poses a challenge for most learning approaches, the ACPLHVAC, utilizing parallel learning components and mechanisms as discussed herein, provides a peer to peer style distributed learning solution which optimises available resources.

Open data sources such as weather data can also be integrated within the ACPLHVAC. In some embodiments, the ACPLHVAC integrates these source via a semantic model which uses predefined ontologies to automatically interpret and understand the relevant data.

The ACPLHVAC can, in some embodiments, continuously probe the environment to try to achieve cost savings using a QoE metric. This allows the system achieve far greater cost savings over other learning thermostats which only rely on set point optimisation. The ACPLHVAC finds user(s) tolerance levels and can elegantly adjust to a lower cost environment with little or no discomfort.

As discussed above, the ACPLHVAC can work in an online manner, meaning that it does not require any pre learned model of its environment in order to approximate the thermal constants of the space within which it resides. From a learning context these problems are considered stationary, i.e. the walls, windows and doors of a home change very infrequently meaning that any learned decision policy will remain valid whilst these conditions also hold. The state of some of these variables may change, i.e. the windows/doors may be in either an open or closed state but their number and position will remain fixed making it an ideal problem area to learn. The ACPLHVAC can autonomously determine their impact on the heating and cooling of the space. The states of these variables can be determined using appropriate sensing devices.

The ACPLHVAC utilises a unique parallel architecture that has not been applied to these types of problems previously and affords a number of advantages over a non-parallel learning solution. Within this design multiple thermostat controllers connected on a network bus can share information with each other to reduce the learning time for an individual controller. These devices could be located within the same building or connect over a network or the internet. Due to the information sharing mechanisms, each controller does not need to learn from scratch and can instead utilise the available information from its peers allowing it to get up to speed much faster than would normally be possible.

The ACPLHVAC can take advantage of instances where buildings share large similarities between them. For instance in an apartment complex many of the units are built to a specific plan and share similar structural materials and similar layouts. Learning a control policy for one apartment would also be useful to act as a basis for approximating thermal constants in another. Similarly for housing estates where all the houses are built according to the same plans and by the same builder. Again a controller which has learned how long it generally takes to heat or cool the space within which it resides will likely operate in a similar fashion in a similar building.

However, the ACPLHVAC is also capable of learning independently if no external information is available and may actually weights its own observations higher than those of its peers even when substantial information is available. This is done because even though buildings may share structural similarities many internal properties can also have a large effect, such as the number of occupants, their demographic and age. This ensures that learning the specifics of the current building (from a heating and cooling perspective) remain priority for the ACPLHVAC.

The ACPLHVAC can also incorporate external weather conditions into the process to ensure that regional anomalies can be handled within the learning process. In addition a further embodiment could also involve part of the learning being carried out in an external location such as a computational cloud with the results transmitted back to the device.

The performance of the ACPLHVAC convergence times is improved dramatically as result of a parallel learning module that allows for knowledge transfer amongst the controllers. This approach can take advantage of previously learned domain knowledge which is transferable between controllers, meaning that similarities between rooms and buildings can easily be shared amongst controllers allowing them to quickly build up knowledge about the environment that they are trying to control. Using approximate geographical locations the learner can also distinguish between the suitability of information, i.e. if a thermostat is located relatively close by, its information is considered to be more useful that one located in another region/country for instance. The idea is that location can play an important part in determining the heating and cooling schedules. Things like climatic conditions, HVAC make/model, building size, construction materials are likely to be similar for thermostat controllers which reside in a similar location i.e. multiple apartments in the housing complex would likely share similar structural features and construction materials, meaning controlling their heating and cooling would be approximately equivalent. Any information shared from observing these environments could then be used as a training mechanism for additional controllers.

In some embodiments, an HVAC system is controlled from a computing device that implements the ACPLHVAC. The following describes an exemplary embodiment of the learning component, replete with algorithmic specifics, describing in detail the techniques employed to learn heating and cooling patterns in an optimal way. This specific example is driven by the user's intervention such as when they adjust the controller or based on feedback through the QoE mechanism. Each time the user makes a decision to turn on/off the HVAC system this acts as a reinforcement which provides a signal to the learning component or algorithm influencing its behaviour and the control policy it learns. Through repeated interactions it learns the appropriate times to operate the HVAC system automatically.

As far as the this implementation of the ACPLHVAC is concerned, the following parameters may be observed when choosing an action, rt: is the room temperature, (source: temperature sensors, unit: degrees Celsius)

rh: is the relative humidity in the room, (source: humidity sensors, unit: Percentage)

lt: the current local date time (unit: hh:mm—dd/mm/yyyy).

t2t: is the time to temperature (unit=minutes)

SP: fixed temperature and relative humidity set points, SP={21° C., 30%} (source: stored in the HVAC internal controller or customer facing controller).

t: learning interval between decisions (source: stored in the HVAC internal controller, and can be configured if desired. Default:1 minute)

coldOn: Cooling is delivered from the HVAC (unit=boolean)

heatOn: Heating is delivered from the HVAC (unit=boolean)

QoE: Current Mean Opinion Score (MOS)

Within each room, the temperature and humidity set points SP define the desired room conditions and are preprogrammed e.g. SP={21° C., 30%}. These can be changed by room users from either controller located in the room or elsewhere, or may be fixed by the system. The autonomous controller attempts to optimise to these set points through learning in an online manner.

The ASHRAE standard (Standard 62-89) stipulates a ventilation of 20 Cubic Feet per Minute (CFM) for an office building. The room ventilation rate can be determined by the number of air changes per hour, given by N=60/Vol where Vol is the volume of the room in square footage and Q is the volumetric flow rate in CFM. The invention could easily optimise the number of air changes per hour based on the occupancy of the room if this information was made available through occupancy sensors. This can be calculated by the following equation $N=60Q/(n\times 20)$ where n is the number of people in the room and 20 CFM is the ASHRAE standard 62-89 recommended ventilation per person for an office building room.

HVAC controller actions are executed at discrete time intervals known as epochs. For instance an epoch of 5 minutes assumes that a controlling action for the HVAC system may be executed at either 10:00 or 10:05, but not at 10:02. The granularity is a configurable parameter and can be adjusted to ensure an optimal configuration such as minutely intervals.

At the end of each epoch the ACPLHVAC observes the current state of the environment and chooses whether or not to execute an automated HVAC action (turn on or off). Table 1 below illustrates the typical information available, with readings for current temperature, humidity, set points and whether or not the room is booked at that particular time.

TABLE 1

Example of the state space, current time is 10:15.

| | Time (lt) | | | | |
|---|---|---|---|---|---|
| | 10:05 | 10:10 | 10:15 | 10:20 | 10:25 |
| Temp (rt) | 19 | 19 | 20 | | |
| Relative Humid (rh) | 38 | 39 | 39 | | |
| Set point (SP) | 21, 40 | 21, 40 | 21, 40 | | |
| Time to temperature (t2t) | 10 | 5 | 0 | | |
| heatOn | False | True | True | | |
| coldOn | False | False | False | | |
| QoE | 3.5 | 3.7 | 4 | | |

In this embodiment, the ACPLHVAC does not rely on averaging historical data and instead updates a value function estimate upon observing new information. Decisions are made based on these learned value function representations. A number of embodiments of reinforcement learning methods could be used for control, including, but not limited to Bayesian RL, SARSA, TD(X), TD(o), Monte Carlo methods, model based approximation techniques combined with methods from dynamic programming and the corresponding action sampling methods such as ε-greedy, unbiased Bayesian sampling, myopic sampling, softmax selection (Gibbs, Boltzmann), greedy, interval estimation, among others.

The ACPLHVAC learning controller can attempt to optimise the heating and cooling of the room as a multi-criteria problem. This means that the system aims to achieve the desired room conditions (defined by SP or the QoE metric) at the minimum cost (with respect to energy). Table 1 illustrates a sample of the state information available to the ACPLHVAC each time.

A processor-implemented method according to some embodiments of the ACPLHVAC comprises: connecting a first thermostat to a network of thermostats; receiving connected unit learning probability distributions; weighting received probability distributions according to criteria establishing unit similarity in a variety of areas; weighting internal probability distribution above networked probability distributions; aggregating internal and weighted network probability distributions; and performing reinforced learning procedure using aggregated probability distributions.

A processor-implemented method according to some embodiments of the ACPLHVAC comprises: connecting a thermostat to a network of thermostats; initializing the thermostats to a transition policy for area benefit; receiving connected thermostat learning probability distributions; performing reinforced learning procedure using aggregated probability distributions; determining a reward in the form of a positive or negative scalar associated with the transition policy for area benefit; sharing internal probability distributions with connected thermostats. A processor-implemented method according to some embodiments of the ACPLHVAC comprises: initializing a thermostat to arbitrary or pre-loaded state values; receiving multiple user feedback in the form of scalars denoting comfort; aggregating user feedback into a scalar denoting mean user comfort; selecting an HVAC action from a predefined set of available HVAC actions based on a transition policy informed by internal and external transition probabilities; entering the next state following the selected HVAC action; receiving a reward in the form of a positive or negative scalar associated with the selected HVAC action and new state as it approaches mean user comfort levels at minimal cost; and updating and exporting probability distributions.

A processor-implemented method according to some embodiments of the ACPLHVAC comprises: initializing to arbitrary or pre-loaded state values; receiving multi-user feedback in the form of scalars denoting comfort; aggregating user feedback into a scalar denoting mean user comfort; selecting an HVAC action from a predefined set of available HVAC actions based on a transition policy informed by internal and external transition probabilities; and entering the next state following the selected HVAC action; receiving a reward in the form of a positive or negative scalar associated with the selected HVAC action and new state to meet without exceeding threshold user comfort levels at minimal cost.

ACPLHVAC Controller

FIG. 5 shows a block diagram illustrating embodiments of a ACPLHVAC controller. In this embodiment, the ACPLHVAC controller 501 may serve to aggregate, process, store, search, serve, identify, instruct, generate, and/or facilitate interactions through various technologies, and/or other related data. The ACPLHVAC can, for example, be configured such that the various components described herein execute environmental control devices or thermostats, and/or on associated servers. Because components of the ACPLHVAC may be distributed, as described below, various devices and/or servers can perform portions of the program logic assigned to them or portions of the program logic normally assigned to the other.

Typically, users, which may be people and/or other systems, may engage information technology systems (e.g., computers) to facilitate information processing. In turn, computers employ processors to process information; such processors 503 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 529 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the ACPLHVAC controller 501 may be connected to and/or communicate with entities such as, but not limited to: one or more users from user input devices 511; peripheral devices 512; an optional cryptographic processor device 528; and/or a communications network 513.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The ACPLHVAC controller 501 may be based on computer systems that may comprise, but are not limited to, components such as: a computer systemization 502 connected to memory 529.

Computer Systemization

A computer systemization 502 may comprise a clock 530, central processing unit ("CPU(s)" and/or "processor(s)" (these terms are used interchangeable throughout the disclosure unless noted to the contrary)) 503, a memory 529 (e.g., a read only memory (ROM) 506, a random access memory (RAM) 505, etc.), and/or an interface bus 507, and most frequently, although not necessarily, are all interconnected and/or communicating through a system bus 504 on one or more (mother)board(s) 502 having conductive and/or otherwise transportive circuit pathways through which instructions (e.g., binary encoded signals) may travel to effectuate communications, operations, storage, etc. The computer systemization may be connected to a power source 586; e.g., optionally the power source may be internal. Optionally, a cryptographic processor 526 and/or transceivers (e.g., ICs) 574 may be connected to the system bus. In another embodiment, the cryptographic processor and/or transceivers may be connected as either internal and/or external peripheral devices 512 via the interface bus I/O. In turn, the transceivers may be connected to antenna(s) 575, thereby effectuating wireless transmission and reception of various communication and/or sensor protocols; for example the antenna(s) may connect to: a Texas Instruments WiLink WL1283 transceiver chip (e.g., providing 802.11n, Bluetooth 3.0, FM, global positioning system (GPS) (thereby allowing ACPLHVAC controller to determine its location)); Broadcom BCM4329FKUBG transceiver chip (e.g., providing 802.11n, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. It should be understood that in alternative embodiments, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 529 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the ACPLHVAC controller and beyond through various interfaces. Should processing requirements dictate a greater amount speed and/or capacity, distributed processors (e.g., Distributed ACPLHVAC), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the ACPLHVAC may be achieved by implementing a microcontroller such as CAST's R8051XC2 microcontroller; Intel's MCS 51 (i.e., 8051 microcontroller); and/or the like. Also, to implement certain features of the ACPLHVAC, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the ACPLHVAC component collection (distributed or otherwise) and/or features may be implemented via the microprocessor and/or via embedded components; e.g., via ASIC, coprocessor, DSP, FPGA, and/or the like. Alternately, some implementations of the ACPLHVAC may be implemented with embedded components that are configured and used to achieve a variety of features or signal processing.

Depending on the particular implementation, the embedded components may include software solutions, hardware solutions, and/or some combination of both hardware/software solutions. For example, ACPLHVAC features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the ACPLHVAC features. A hierarchy of programmable interconnects allow logic blocks to be interconnected as needed by the ACPLHVAC system designer/administrator, somewhat like a one-chip programmable breadboard. An FPGA's logic blocks can be programmed to perform the operation of basic logic gates such as AND, and XOR, or more complex combinational operators such as decoders or mathematical operations. In most FPGAs, the logic blocks also include memory elements, which may be circuit flip-flops or more complete blocks of memory. In some circumstances, the ACPLHVAC may be developed on regular FPGAs and then migrated into a fixed version that more resembles ASIC implementations. Alternate or coordinating implementations may migrate ACPLHVAC controller features to a final ASIC instead of or in addition to FPGAs. Depending on the implementation all of the aforementioned embedded components and microprocessors may be considered the "CPU" and/or "processor" for the ACPLHVAC.

Power Source

The power source 586 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 586 is connected to at least one of the interconnected subsequent components of the ACPLHVAC thereby providing an electric current to all subsequent components. In one example, the power source 586 is connected to the system bus component 504. In an alternative embodiment, an outside power source 586 is provided through a connection across the I/O 508 interface.

For example, a USB and/or IEEE 1394 connection carries both data and power across the connection and is therefore a suitable source of power.

Interface Adapters

Interface bus(ses) 507 may accept, connect, and/or communicate to a number of interface adapters, conventionally although not necessarily in the form of adapter cards, such as but not limited to: input output interfaces (I/O) 508, storage interfaces 509, network interfaces 510, and/or the like. Optionally, cryptographic processor interfaces 527 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 509 may accept, communicate, and/or connect to a number of storage devices such as, but not limited to: storage devices 514, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 510 may accept, communicate, and/or connect to a communications network 513. Through a communications network 513, the ACPLHVAC controller is accessible through remote clients 533*b* (e.g., computers with web browsers) by users 533*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed ACPLHVAC), architectures may similarly be employed to pool, load balance, and/or otherwise increase the communicative bandwidth required by the ACPLHVAC controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 510 may be used to engage with various communications network types 513. For example, multiple network interfaces may be employed to allow for the communication over broadcast, multicast, and/or unicast networks.

Input Output interfaces (I/O) 508 may accept, communicate, and/or connect to user input devices 511, peripheral devices 512, cryptographic processor devices 528, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/b/g/n/x; Bluetooth; cellular (e.g., code division multiple access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 511 often are a type of peripheral device 512 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 512 may be connected and/or communicate to I/O and/or other facilities of the like such as network interfaces, storage interfaces, directly to the interface bus, system bus, the CPU, and/or the like. Peripheral devices may be external, internal and/or part of the ACPLHVAC controller. Peripheral devices may include: antenna, audio devices (e.g., line-in, line-out, microphone input, speakers, etc.), cameras (e.g., still, video, webcam, etc.), dongles (e.g., for copy protection, ensuring secure transactions with a digital signature, and/or the like), external processors (for added capabilities; e.g., crypto devices 528), force-feedback devices (e.g., vibrating motors), network interfaces, printers, scanners, storage devices, transceivers (e.g., cellular, GPS, etc.), video devices (e.g., goggles, monitors, etc.), video sources, visors, and/or the like. Peripheral devices often include types of input devices (e.g., cameras).

It should be noted that although user input devices and peripheral devices may be employed, the ACPLHVAC controller may be embodied as an embedded, dedicated, and/or monitor-less (i.e., headless) device, wherein access would be provided over a network interface connection.

Cryptographic units such as, but not limited to, microcontrollers, processors 526, interfaces 527, and/or devices 528 may be attached, and/or communicate with the ACPLHVAC controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of the CPU. Equivalent microcontrollers and/or processors may also be used. Other commercially available specialized cryptographic processors include: Broadcom's CryptoNetX and other Security Processors; nCipher's nShield; SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 529. However, memory is a fungible technology and resource, thus, any number of memory embodiments may be employed in lieu of or in concert with one another. It is to be understood that the ACPLHVAC controller and/or a computer systemization may employ various forms of memory 529. For example, a computer systemization may be configured wherein the operation of on-chip CPU memory (e.g., registers), RAM, ROM, and any other storage devices are provided by a paper punch tape or paper punch card mechanism; however, such an embodiment would result in an extremely slow rate of operation. In a typical configuration, memory 529 will include ROM 506, RAM 505, and a storage device 514. A storage device 514 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 529 may contain a collection of program and/or database components and/or data such as, but not limited to: operating system component 515; information server component 516; user interface component 517; ACPLHVAC database component 519; cryptographic server component 520; TSA Component 841; and/or the like (i.e., collectively a component collection). The aforementioned components may be incorporated into (e.g., be sub-components of), loaded from, loaded by, or otherwise operatively available to and from the ACPLHVAC component(s) 535.

Any component may be stored and accessed from the storage devices and/or from storage devices accessible through an interface bus. Although program components such as those in the component collection, typically, are stored in a local storage device 514, they may also be loaded and/or stored in other memory such as: remote "cloud" storage facilities accessible through a communications network; integrated ROM memory; via an FPGA or ASIC implementing component logic; and/or the like.

Operating System Component

The operating system component 515 is an executable program component facilitating the operation of the ACPLHVAC controller. Typically, the operating system facilitates access of I/O, network interfaces, peripheral devices, storage devices, and/or the like. The operating system may be a highly fault tolerant, scalable, and secure system such as: Unix and Unix-like system distributions (such as AT&T's UNIX; Berkley Software Distribution (BSD) variations such as FreeBSD, NetBSD, OpenBSD, and/or the like; Linux distributions such as Red Hat, Debian, Ubuntu, and/or the like); and/or the like operating systems. However, more limited and/or less secure operating systems also may be employed such as Apple OS-X, Microsoft Windows 2000/2003/3.1/95/98/CE/Millenium/NT/Vista/XP/Win7 (Server), and/or the like. An operating system may communicate to and/or with other components in a component collection, including itself, and/or the like. Most frequently, the operating system communicates with other program components, user interfaces, and/or the like. The operating system, once executed by the CPU, may enable the interaction with communications networks, data, I/O, peripheral devices, program components, memory, user input devices, and/or the like. The operating system may provide communications protocols that allow the ACPLHVAC controller to communicate with other entities through a communications network 513. Various communication protocols may be used by the ACPLHVAC controller as a subcarrier transport mechanism for interaction, such as, but not limited to: multicast, TCP/IP, UDP, unicast, and/or the like.

Information Server Component

An information server component 516 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., ICQ, Internet Relay Chat (IRC), Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Representational State Transfer (REST) and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the ACPLHVAC controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the ACPLHVAC database component 519, operating system component 515, other program components, user interfaces, and/or the like.

Access from the Information Server Component 516 to the ACPLHVAC database component 519 may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the ACPLHVAC. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the ACPLHVAC as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser. Also, an information server may contain, communicate, generate, obtain, and/or provide program component, system, user, and/or data communications, requests, and/or responses.

User Interface Component

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows, web interface libraries such as, but not limited to, Dojo, jQuery UI, MooTools, Prototype, script.aculo.us, SWFObject, Yahoo! User Interface, any of which may be used and provide a baseline and means of accessing and displaying information graphically to users.

A user interface component 517 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating system component 515, other program components, and/or the like. The user interface may contain, communicate, generate, obtain, and/or provide program component, system, user, and/or data communications, requests, and/or responses.

Cryptographic Server Component

A cryptographic server component 520 is a stored program component that is executed by a CPU 503, cryptographic processor 526, cryptographic processor interface 527, cryptographic processor device 528, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash operation), passwords, Rivest Cipher (RC5), Rijndael (AES), RSA, Secure Hash Algorithm (SHA), Secure Socket Layer (SSL), Secure Hypertext Transfer Protocol (HTTPS), and/or the like. Employing such encryption security protocols, the ACPLHVAC may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the ACPLHVAC component to engage in secure transactions if so desired. The cryptographic component facilitates the secure accessing of resources on the ACPLHVAC and facilitates the access of secured resources on remote systems; i.e., it may act as a client and/or server of secured resources. Most frequently, the cryptographic component communicates with information server component 516, operating system component 515, other program components, and/or the like. The cryptographic component may contain, communicate, generate, obtain, and/or provide program component, system, user, and/or data communications, requests, and/or responses.

ACPLHVAC Database Component

The ACPLHVAC database component 519 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the ACPLHVAC database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of capabilities encapsulated within a given object. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 519 includes several tables 519*a-c*. A Users table 519*a* may include fields such as, but not limited to: user_ID, first_name, last_name, state, license_ID, user_location, user_profile, user_feedbac, user_qoe, user_comfort, user_device, and/or the like. A Device table 519*b* may include fields such as, but not limited to: device_ID, device_state, device_initialization, device_name, device_ip, device_type, device_model, device_system, device_version, and/or the like. An HVAC Profile table 519*c* may include fields such as, but not limited to: HVAC_ID, HVAC_model, HVAC_maker_ID, HVAC_parameters, HVAC_output, HVAC_Input, and/or the like.

In one embodiment, the ACPLHVAC database component may interact with other database systems. For example, when employing a distributed database system. In such an embodiment, queries and data access by any ACPLHVAC component may treat the combination of the ACPLHVAC database component results and results from a second segment in a distributed database system as an integrated database layer. Such a database layer may be accessed as a single database entity, for example through ACPLHVAC database component 519, by any ACPLHVAC component.

In one embodiment, user programs may contain various user interface primitives, which may serve to update the ACPLHVAC. Also, various accounts may require custom database tables depending upon the environments and the types of clients the ACPLHVAC may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 519*a-c*. The ACPLHVAC may be configured to keep track of various settings, inputs, and parameters via database controllers.

The ACPLHVAC database may communicate to and/or with other components in a component collection, including itself, and/or facilities of the like. Most frequently, the ACPLHVAC database communicates with the ACPLHVAC component, other program components, and/or the like. The database may contain, retain, and provide information regarding other nodes and data.

ACPLHVAC Component

The ACPLHVAC component 535 is a stored program component that is executed by a CPU. In one embodiment, the ACPLHVAC component incorporates any and/or all combinations of the aspects of the ACPLHVAC that was discussed in the previous figures. As such, the ACPLHVAC affects accessing, obtaining and the provision of information, services, actions, and/or the like across various communications networks. The features and embodiments of the ACPLHVAC discussed herein increase network efficiency by reducing data transfer requirements and processor time. As a consequence, only relevant data is transferred, and efficiencies in providing comfortable environmental conditions are obtained, with data processing and transfer latencies reduced. In many cases, such reduction in storage, transfer time, bandwidth requirements, latencies, etc., will reduce the capacity and structural infrastructure requirements to support the ACPLHVAC's features and facilities, and in many cases reduce the costs, energy consumption/requirements, and extend the life of ACPLHVAC's underlying infrastructure. Similarly, many of the features and mechanisms are designed to be easier for users to use and access, thereby broadening the audience that may enjoy/employ and exploit the feature sets of the ACPLHVAC; such ease of use also helps to increase the reliability of the ACPLHVAC. In addition, the feature sets include heightened security as noted via the Cryptographic components 520, 526, 528 and throughout, making access to the features and data more reliable and secure.

The ACPLHVAC component enabling access of information between nodes may be developed by employing standard development tools and languages such as, but not limited to: Apache components, Assembly, ActiveX, binary executables, (ANSI) (Objective–) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery; jQuery UI; MooTools; Prototype; script.aculo.us; Simple Object Access Protocol (SOAP); SWFObject; Yahoo! User Interface; and/or the like), WebObjects, and/or the like. In one embodiment, the ACPLHVAC server employs a cryptographic server to encrypt and decrypt communications. The ACPLHVAC component may communicate to and/or with other components in a component collection, including itself, and/or facilities of the like. Most frequently, the ACPLHVAC component communicates with the ACPLHVAC database component 519, operating system component 515, other program components, and/or the like. The ACPLHVAC may contain, communicate, generate, obtain, and/or provide program component, system, user, and/or data communications, requests, and/or responses.

Distributed ACPLHVAC Components

The structure and/or operation of any of the ACPLHVAC node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the ACPLHVAC controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, Representational State Transfer (REST), process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

*w3c*-post http:// . . . Value1 where Value1 is discerned as being a parameter because "http://" is part of the grammar syntax, and what follows is considered part of the post value. Similarly, with such a grammar, a variable "Values" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. Further, the parsing grammar may be used beyond message parsing, but may also be used to parse: databases, data collections, data stores, structured data, and/or the like. Again, the desired configuration will depend upon the context, environment, and requirements of system deployment.

Additional ACPLHVAC Configurations

In order to address various issues and advance the art, the entirety of this application for ACPLHVAC (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed innovations may be practiced. The advantages and features of the application are of a representative sample of embodiments only, and are not exhaustive and/or exclusive. They are presented only to assist in understanding and teach the claimed principles. It should be understood that they are not representative of all claimed innovations. As such, certain aspects of the disclosure have not been discussed herein. That alternate embodiments may not have been presented for a specific portion of the innovations or that further undescribed alternate embodiments may be available for a portion is not to be considered a disclaimer of those alternate embodiments. It will be appreciated that many of those undescribed embodiments incorporate the same principles of the innovations and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the innovations, and inapplicable to others. In addition, the disclosure includes other innovations not presently claimed. Applicant reserves all rights in those presently unclaimed innovations including the right to claim such innovations, file additional applications, continuations, continuations-in-part, divisionals, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a ACPLHVAC individual and/or enterprise user, database configuration and/or relational model, data type, data transmission and/or network framework, syntax structure, and/or the like, various embodiments of the ACPLHVAC, may be implemented that enable a great deal of flexibility and customization as described herein.

What is claimed is:

1. An intelligent environmental control method, comprising;

collecting, at a thermostat, information about a first environmental condition from at least one sensor;

comparing, at the thermostat, the collected information to an initial probability distribution analysis to determine a divergence factor;

selecting, at the thermostat, a control action based on the determined divergence factor being configured to control a state change of the thermostat; and updating a state change of the thermostat using the selected control action.

2. The method of claim 1, wherein the method is performed at each of a plurality of thermostats.

3. The method of claim 2, wherein the plurality of thermostats are operatively connected to form a thermostat network.

4. The method of claim 3, wherein at least one or more of the plurality of thermostats within the thermostat network are initially independently controlled.

5. The method of claim 1, wherein the collected information about a first environmental condition is utilized to approximate the initial probability distribution analysis.

6. The method of claim 1, wherein adaptive thresholds are utilized to select a control action for the thermostat.

7. The method of claim 1, wherein updating a state change of the they thermostat involves devices other than the thermostat.

8. The method of claim 1, wherein stored data is used to select the control action for the thermostat.

9. The method of claim 1, wherein open data sources are utilized to select the control action for the thermostat.

10. An intelligent environmental control apparatus, comprising:

a network;

a thermostat logically connected to the network, the thermostat including a control node configured to:

collect at a thermostat, information about a first environmental condition from at least one sensor;

compare at the thermostat, the collected information to an initial probability distribution analysis to determine a divergence factor;

select at the thermostat, a control action based on the determined divergence factor being configured to control a state change of the thermostat; and update a state change of the thermostat using the selected control action.

11. The apparatus of claim 10, further comprising a plurality of thermostats each with a control node configured to perform the collecting, comparing, selecting and updating at its respective thermostat.

12. The apparatus of claim 11, wherein the plurality of thermostats are operatively connected to form a thermostat network.

13. The apparatus of claim 12, wherein at least one or more of the plurality of thermostats within the thermostat network are initially independently controlled.

14. The apparatus of claim 10, wherein the collected information about a first environmental condition is utilized to approximate the initial probability distribution analysis.

15. The apparatus of claim 10, wherein adaptive thresholds are utilized to select a control action for the thermostat.

16. The apparatus of claim 10, wherein updating a state change of the thermostat involves devices other than the thermostat.

17. The apparatus of claim 10, wherein stored data is used to select the control action for the thermostat.

18. The apparatus of claim 10, wherein open data sources are utilized to select the control action for the thermostat.

19. A non-transitory computer readable medium having computer readable instructions stored thereon that, when executed by a processor of a computing device, cause the computing device to:

collect, at a thermostat, information about a first environmental condition from at least one sensor;

compare, at the thermostat, the collected information to an initial probability distribution analysis to determine a divergence factor;

select, at the thermostat, a control action based on the determined divergence factor being configured to control a state change of the thermostat; and update a state change of the thermostat using the selected control action.

* * * * *